US005188190A

United States Patent [19]

Skaalure

[11] Patent Number: 5,188,190

[45] Date of Patent: Feb. 23, 1993

[54] METHOD FOR OBTAINING CORES FROM A PRODUCING WELL

[75] Inventor: Eric W. Skaalure, Anchorage, Ak.

[73] Assignee: Atlantic Richfield Company, Los Angeles, Calif.

[21] Appl. No.: 752,308

[22] Filed: Aug. 30, 1991

[51] Int. Cl.[5] ..... E21B 7/06; E21B 25/16

[52] U.S. Cl. ..... 175/58; 175/81; 175/248

[58] Field of Search ..... 175/20, 58, 78, 79, 175/80, 81, 246, 248; 166/385, 117.5, 244.1

[56] References Cited

U.S. PATENT DOCUMENTS 2,324,682 7/1943 De Long ..... 175/81

5,103,921 4/1992 Zeer et al. ..... 175/81

*Primary Examiner*—William P. Neuder

*Attorney, Agent, or Firm*—Michael E. Martin

[57] ABSTRACT

Core samples are obtained through production wells by inserting a milling tool through the production tubing string on the distal end of coilable tubing to mill out a window in the well casing. The milling tool is deflected by a whipstock set in the casing at a predetermined point and encased in cement which, upon setting, is bored to form a pilot bore for the milling tool. A fluid-motor-driven core barrel is run into the well on the coilable tubing after the milling operation is complete and core drilling is carried out in an underbalanced condition by reducing wellbore pressure through gas lift so as to minimize core invasion by wellbore fluids, including spent core drilling fluids.

6 Claims, 2 Drawing Sheets

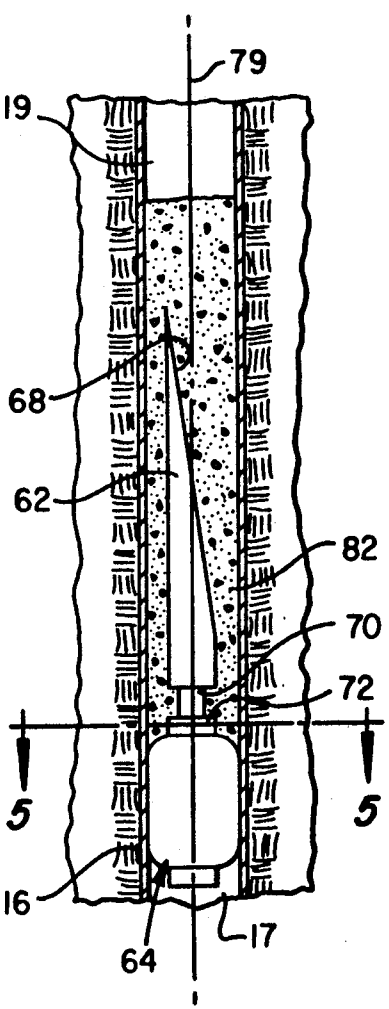
FIG. 2
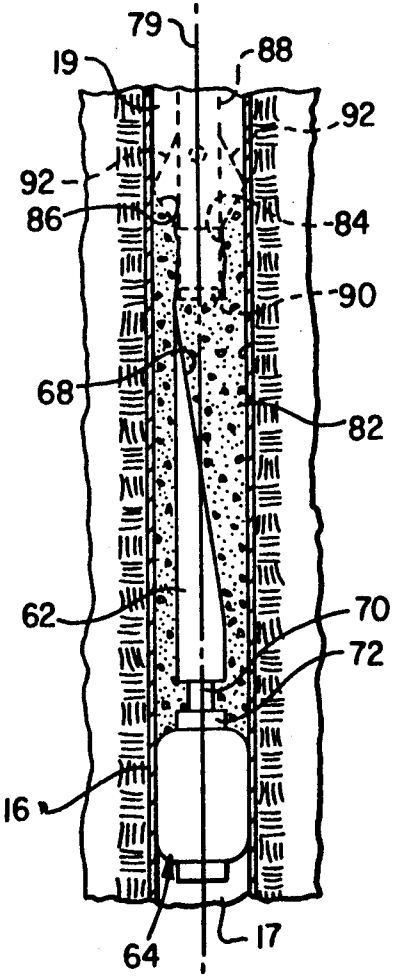
FIG. 3
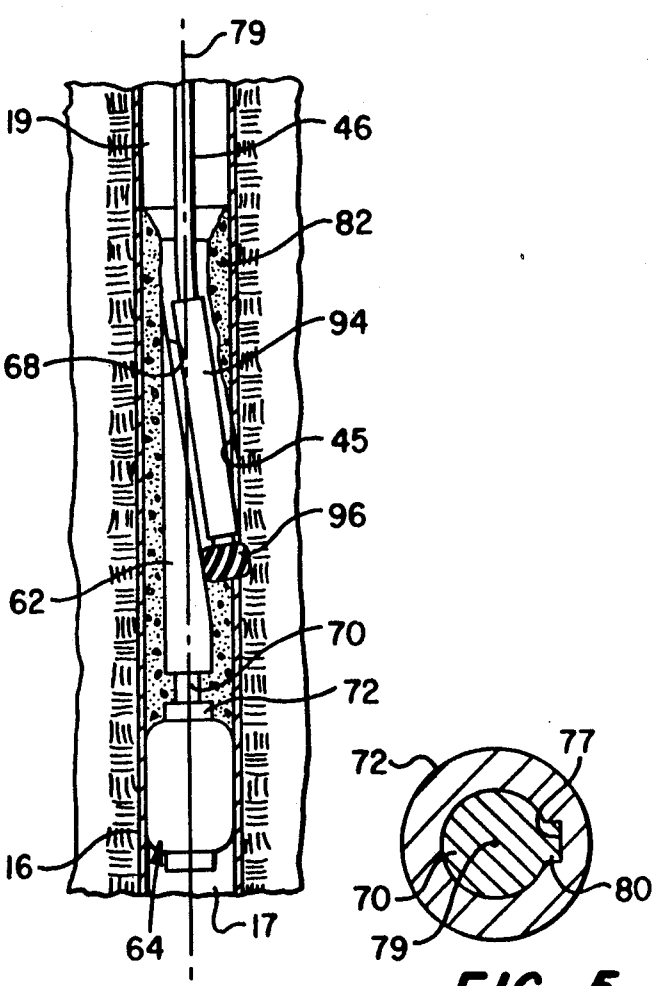
FIG. 4
FIG. 5

METHOD FOR OBTAINING CORES FROM A PRODUCING WELL

BACKGROUND OF THE INVENTION

1. Field of the Invention

The present invention pertains to a method for obtaining low invasion core samples from a subterranean formation through a producing well using coilable tubing to run the drilling and coring tools.

2. Background

Producing oil and gas from subterranean formations through wellbores sometimes requires inspection of formation conditions to analyze production characteristics and prescribe future production techniques. Analysis of formation characteristics or changes is usually dependent on the ability to take suitable core samples of the formation in the vicinity of the wellbore. Conventional coring operations require that the well be shut in while a drilling rig is brought in and operated to perform the coring operation. This process is time consuming and expensive and requires shut-in of the well during all phases of the drilling and core sample acquisition process. Improved methods and apparatus for obtaining cores are described in U.S. patent applications entitled: Coring With Tubing Run Tools From a Producing Well by John C. Braden, et al and Permanent Whipstock and Placement Method by David D. Hearn, et al, both assigned to the assignee of the present invention, and both of even filing date with this application.

Another problem associated with obtaining core samples from subterranean formations pertains to reducing invasion of the core by unwanted fluids such as the cuttings evacuation fluid used during the core acquisition process. Low invasion coring has been successful only when the core diameters exceed approximately 4.0 inches. As the core diameter is decreased, the core surface area to pore volume ratio increases so that the invasion of fluids becomes greater. At core diameters of less than about 2.5 inches, coring fluid invasion often reaches the center of the core. Accordingly, this limitation on core diameter has, heretofore, precluded obtaining core samples through small diameter tubing strings and other wellbore structures of a diameter less than conventional casing diameters thereby, again, requiring the use of a drilling rig to pull the tubing strings and provide a drillstring for obtaining a core sample of sufficient diameter to prevent invasion of the core center. However, the present invention overcomes the disadvantages of conventional coring by providing a unique method for obtaining core samples from and through a production well.

SUMMARY OF THE INVENTION

The present invention provides a method of obtaining low invasion core samples from subterranean formations through a well. In accordance with an important aspect of the present invention a low-invasion core is obtained from a producing formation through a producing well without removing the well from production and by performing drilling and coring operations in a so-called underbalanced condition, that is by maintaining wellbore pressure at or below the formation pressure.

The coring method of the present invention is particularly advantageously carried out using coilable tubing for performing the drilling and core sample-taking process while producing wellbore fluids and coring fluids through a production tubing string in the wellbore which is operating under gas lift. In this regard wellbore pressure in the vicinity of the core sampling area of the formation is reduced by injection of gas into the tubing string to reduce the hydrostatic pressure in the tubing string fluid column. In this way, bottom hole pressure is reduced to less than the formation ambient pressure and formation fluids are produced into the wellbore together with coring fluids.

In accordance with another aspect of the present invention, a low-invasion, small diameter core is obtained which has reduced exposure to coring fluids and wellbore fluids during the core acquisition process and while the wellbore is maintained essentially in a production status and wellbore pressure is controlled at the wellhead by conventional wellhead equipment. Moreover, fluids can be used which minimize contamination of the core in the core acquisition process.

Those skilled in the art will recognize the above-described features and advantages of the present invention together with other superior aspects thereof upon reading the detailed description which follows in conjunction with the drawing.

BRIEF DESCRIPTION OF THE DRAWING

FIG. 2 is a section view showing the installation of a whipstock for orienting a casing milling tool;

FIG. 3 is a view similar to FIG. 2 showing the operation of reaming out cement to provide a pilot bore for the casing milling tool;

FIG. 4 is a view similar to FIG. 3 showing a coiled tubing conveyed milling tool milling a window in the well casing; and FIG. 5 is a section view taken along the line 5—5 of FIG. 2.

DESCRIPTION OF THE PREFERRED EMBODIMENTS

Figures 1A, 1B:
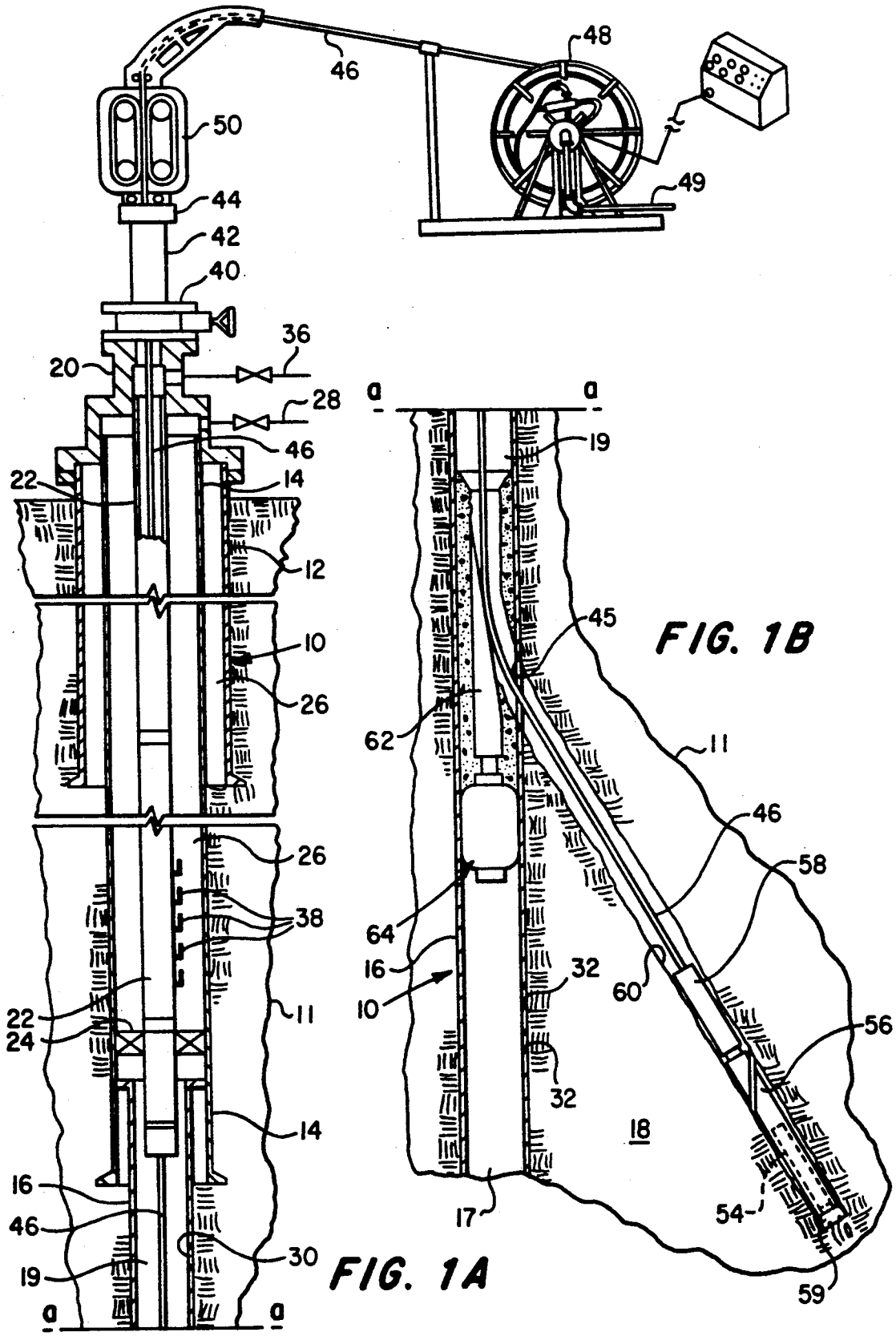
FIG. 1A is a vertical section view, in somewhat schematic form, of a well structure of a type which is produced by gas lift or gas injection and showing a coilable tubing inserted through the production tubing string.
FIG. 1B is a continuation of FIG. 1 from the line a—a showing a core acquisition in accordance with the method of the present invention.

In the description which follows, like parts are marked throughout the specification and drawing with the same reference numerals, respectively. The drawing figures are not to scale and certain features are shown in schematic form or are exaggerated in scale in the interest of clarity and conciseness.

Referring to FIGS. 1A and 1B, there is illustrated in somewhat schematic form an oil production well, generally designated by the number 10, extending into an earth formation 11. The well 10 includes a conventional surface casing 12, an intermediate casing string 14 and a production liner or casing 16 extending into an oil-producing zone 18 of formation 11. A conventional wellhead 20 is connected to the casing strings 12 and 14 and is also suitably connected to a production fluid tubing string 22 extending within the casing 14 and partially within the casing 16. A suitable seal 24 is formed in the wellbore between the tubing 22 and casing 14 by a packer or the like and which delimits an annulus 26 between the casing 14 and the tubing string. The well 10 is adapted to produce fluids from the zone of interest 18 through suitable perforations 30 and/or 32 formed in the production casing 16 at desired intervals. Produced fluids are assisted in their path to the surface, for transport through a production flow line 36, by gas which is injected into the space 26 and enters the production tubing string 22 through suitable gas lift valves indicated at 38. The aforedescribed well structure is substantially conventional, known to those skilled in the art and is exemplary of a well which may be produced through natural formation pressures with or without the assistance of gas injection to reduce the pressure in the interior spaces 17, 19 of the casing 16.

The wellhead 20 is provided with a conventional crown valve 40 and a lubricator 42 mounted on the wellhead above the crown valve. The lubricator 42 includes a stuffing box 44 through which may be inserted or withdrawn a coilable metal tubing string 46 which, in FIGS. 1A and 1B is shown extending through the tubing string 22 into the casing 16 and diverted through a window 45 in the casing (FIG. 1B) as will be explained in further detail herein. The tubing string 46 is adapted to be inserted into and withdrawn from the well 10 by way of a conventional tubing injection unit 50 and the tubing string 46 may be coiled onto a storage reel 48 of a type described in further detail in U.S. Pat. No. 4,685,516 to Smith et al, and assigned to the assignee of the present invention. The lubricator 42 is of a conventional configuration which permits the connection of certain tools to the distal end of the tubing string 46 for insertion into and withdrawal from the wellbore space 19 by way of the production tubing string 22.

In accordance with the present invention, a method is provided for obtaining a core sample of the formation 18, which core sample is indicated by the numeral 54 in FIG. 1B. The core sample 54 is shown inserted in a core barrel 56 connected to a pressure-fluid-driven motor 58 which is connected to the distal end of the tubing string 46 as indicated. The core sample 54 is being extracted from the formation 18 without interrupting production from the well 10. In fact, the window 45 which has been cut into the formation 18 also provides an entry port into the interior space 19 of the casing 16 to allow formation fluids to enter the casing and to be produced up through the tubing string 22 in the same manner that fluids enter the tubing string from the perforations or ports 30 and/or 32. The motor 58 and the core barrel 56 may be of substantially conventional construction, only being of a diameter small enough to be inserted into the space 19 through the tubing string 22. The motor 58 is driven by pressure fluid to rotate the core barrel 56 to cut a core 54 using a core barrel cutting bit 59, which pressure fluid, such as water or diesel fuel, is supplied from a source, not shown, by way of a conduit 49 and the reel 48 to be pumped down through the tubing 46 for propelling the motor 58 and for serving as a cuttings evacuation fluid while forming the bore 60 in the formation 18. As shown in FIG. 1B the tubing string 46 has been diverted into the direction illustrated by a whipstock 62 which is positioned within the space 17, 19 in accordance with a method and apparatus which will be described in further detail herein.

As previously mentioned, in order to provide the core 54, the diameter of the core barrel 56 and the motor 58 must be less than the inside diameter of the tubing string 22. By way of example, it is not uncommon to have production tubing strings in wells in the Prudhoe Bay Oil Field, Ak., which have an inside diameter of about 4.50 inches. This space limitation dictates that the diameter of the core 54 may be required to be as small as 2.4 inches. Such small diameter cores, when obtained with conventional coring techniques will suffer invasion all the way to the center of the core from the so-called coring fluid, that is the fluid being used to propel the motor 58 and the core barrel 56. Such an invasion will damage the core to the extent that it cannot be properly analyzed.

The aforementioned advantages of using the tubing 46 and the tubing injection unit 50, in place of a conventional drilling rig for obtaining the core 54 are enhanced by the relatively short times required to "trip" in and out of the wellbore including the bore 60 in the process of core acquisition and retrieval. This process alone also reduces the exposure of the core to unwanted fluids and decreases core contamination caused by diffusion of the coring fluid into the core sample itself. The relatively short acquisition time provided by the injection and retrieval of the core barrel 56 utilizing the tubing 46 improves the possibility of virtually no invasion of the coring fluid toward the core center.

Along with the above-mentioned advantages the method of the present invention also permits production of wellbore fluids through the tubing string 22 during core acquisition. If the formation is producing fluids through the perforations 30 as well as the window 45, or plural windows if plural cores are taken from different directions within the formation 18, this production is not interrupted by the core acquisition process. In fact, the advantage of continued production also works synergistically with the core acquisition method of the present invention in that the cuttings generated during cutting the window 45 and the bore 60 are more effectively removed from the wellbore with assistance from production fluid since the coring fluid alone may not be circulated at a sufficient rate to remove all the cuttings as compared with coring fluid circulation rates utilized in conventional coring with a rotary type drilling rig.

Referring to FIG. 1B, as well as FIGS. 2 through 5, the whipstock 62 is set in place to provide for cutting the window 45 and giving direction to the eventual formation of the bore 60 in accordance with a unique method and apparatus. Prior to cutting the window 45 an inflatable packer 64 is conveyed into the wellbore and set in the position shown within the casing 16 by traversing the packer through the tubing string 22 on the distal end of the tubing 46. The packer 64 may have an inflatable bladder and setting mechanism similar to the packer described in U.S. Pat. No. 4,787,446 to Howell et al and assigned to the assignee of the present invention. Moreover, the tubing string 46 may be released from the packer 64, once it is set in the position shown, and from other devices described herein, by utilizing a coupling of the type described in U.S. Pat. No. 4,913,229 to Hearn and also assigned to the assignee of the present invention.

The whipstock 62 includes a guide surface 68 formed thereon. The whipstock 62 also includes a shank portion 70 which is insertable within a mandrel 72 forming part of the packer 64. The orientation of the whipstock 62 is carried out utilizing conventional orientation methods. For example, the mandrel 72 may be provided with a suitable keyway 77, FIG. 5, formed therein. Upon setting the packer 64 in the casing 16, a survey instrument would be lowered into the wellbore to determine the orientation of the keyway 77 with respect to a reference point and the longitudinal central axis 79. The whipstock shank 70 could then be formed to have a key portion 80, FIG. 5, positioned with respect to the guide surface 68 such that upon insertion of the whipstock 62 into the mandrel 72, the key 80 would orient the surface 68 in the preferred direction with respect to the axis 79 and the formation 18.

Upon setting the whipstock 62 in position as shown in FIG. 2 a quantity of cement 82 is injected into the casing by conventional methods including pumping cement through the tubing 46 to encase the whipstock 62 as shown. Once the cement 82 has set, a pilot bore 84 may be formed in the cement as indicated in FIG. 3, said bore including a funnel-shaped entry portion 86. The bore 84 and the funnel-shaped entry portion 86 may be formed using a cutting tool 88 having a pilot bit portion 90 and retractable cutting blades 92 formed thereon. The cutting tool 88 may be of a type disclosed in U.S. Pat. No. 4,809,793 to C. D. Hailey which describes a tool which may be conveyed on the end of a tubing string, such as the tubing string 46, and rotatably driven by a downhole motor similar to the motor 58 to form the pilot bore 84 and the entry portion 86. The pilot bore portion 84 is preferably formed substantially coaxial with the axis 79.

Upon formation of the pilot bore 84, the tool 88 is withdrawn from the wellbore through the tubing string 22 and replaced by a milling motor 94 having a rotary milling tool 96 connected thereto. The motor 94 and milling tool 96 are lowered into the wellbore through the tubing string 22, centered in the wellbore by engagement with the cement plug 82 through the pilot bore 84 and then pressure fluid is supplied to the motor 94 to commence milling out a portion of the cement plug and the side wall of the casing 16 to form the window 45 as shown in FIG. 4.

The milling operation is continued until the milling tool 96 has formed the window 45 whereupon the tubing string 46 is again withdrawn through the tubing string 22 until the motor 94 and cutter 96 are in the lubricator 42. The motor 94 may then be disconnected from the tubing string 46 and replaced by the motor 58 and the core barrel 56. The motor 58 and core barrel 56 are then run into the well 10 through the tubing string 22 and core drilling is commenced to form the bore 60 and to obtain one or more cores 54.

During the operation to acquire one or more cores 54, gas is injected into the space 26 and through the gas lift valves 38 into the production tubing string 22 to convey fluids up through the tubing string 22 and to the conduit 36 through the wellhead 20 to reduce the pressure in the bore 60 and the wellbore space 19 to a value below the nominal pressure in the formation 18. Accordingly, formation fluids are produced into the wellbore and coring fluid will not flow into the formation from the wellbore. Coring fluids will also not enter the core 54 since pressure in the core will be greater than in the bore 60 and the wellbore space 19. Accordingly, continued production of fluids from the well by, for example, utilizing gas injection to lift fluid through the tubing string 22, or, if well conditions permit, increasing flow through conduit 36 will provide a core 54 with relatively low invasion of fluids into the core proper and essentially no fluid invasion to the core center. The well 10 may, of course, be allowed to continue production after withdrawal of the core barrel 56 with the tubing 46. After one or more cores are obtained the new perforations or windows, such as the window 45, may continue to serve as perforations for allowing production of fluids from the formation 18 or the window 45 may be suitably sealed off with conventional equipment.

Thanks to the methods and equipment described herein, a unique method of obtaining core samples from production wells may be carried out using coilable tubing or other relatively small diameter strings insertable through the well production tubing string without shutting the well in and without requiring the use of conventional drilling rigs. Moreover, higher quality cores may be obtained by eliminating conventional weighted drilling fluids and by reducing the wellbore pressure during the core acquisition process. The equipment described herein, such as the tubing injection apparatus 50, the lubricator 42, the wellhead 20, the gas lift injection valves 38, the seal 24, the motors 58 and 94, the core barrel 56 and the packer 64 is available from commercial sources or may be provided using knowledge available to those of ordinary skill in the art.

Although a preferred embodiment of the present invention has been described in detail herein, those skilled in the art will recognize that various substitutions and modifications may be made to the present invention without departing from the scope and spirit of the appended claims.

What is claimed is:

1. A method of acquiring a core sample from an earth formation through a well, said well having a wellhead, a tubing string, and means for injection a length of tubing into the well through said tubing string, said method comprising the steps of:

providing said length of tubing with core acquisition means connected thereto, inserting said core acquisition means and said length of tubing into said well through said tubing string and drilling into said formation with said core acquisition means to obtain a core sample from said formation;

reducing the pressure in the wellbore in the vicinity of the point of entry of said core acquisition means into said formation below the nominal formation pressure so as to minimize the invasion of fluids into said core sample during the acquisition thereof; and withdrawing said core acquisition means and said core sample from said well.

2. A method of acquiring a core sample from an earth formation through a producing well, said well having a wellhead, a production tubing string, and means for injecting a length of coilable tubing into the well through said tubing string, comprising the steps of:

providing said length of tubing with core acquisition means connected thereto, inserting said core acquisition means and said length of tubing into said well through said production tubing string and drilling into said formation with said core acquisition means to obtain a core sample from said formation;

evacuating cuttings from said formation with coring fluid injected into said formation through said length of tubing and fluid produced from said formation into said wellbore; and reducing the pressure in the wellbore in the vicinity of the point of entry of said core acquisition means into said formation to minimize the invasion of said fluids into said core sample during the acquisition thereof.

3. The method set forth in claim 2 wherein: the step of reducing the pressure in said wellbore is carried out by injecting gas into said well to lift wellbore fluids through said production tubing string.

4. The method set forth in claim 2 including the step of:

withdrawing said core acquisition means with said length of tubing through said tubing string while producing fluids through said tubing string from said well.

5. A method of acquiring a core sample from an earth formation through a well, said well having a wellhead, a tubing string, and means for injection length of tubing into the well through said tubing string, said method comprising the steps of:

providing said length of tubing with core acquisition means connected thereto, said core acquisition means including fluid motor means drivably connected thereto, inserting said core acquisition means and said length of tubing into said well through said tubing string and drilling into said formation with said core acquisition means to obtain a core sample from said formation;

evacuating cuttings from said formation utilizing fluid from said fluid motor means and fluid produced from said formation into said wellbore;

reducing the pressure in said wellbore in the vicinity of the point of entry of said core acquisition means into said formation to minimize the invasion of fluids into said core sample during the acquisition thereof; and withdrawing said core acquisition means and said core sample from said well.

6. A method of acquiring a core sample from an earth formation through a well, said well having a wellhead, a tubing string, and means for injecting a length of tubing into said well through said tubing string, said method comprising the steps of:

providing said length of tubing with core acquisition means connected thereto, inserting said core acquisition means and said length of tubing into said well through said tubing string and drilling into said formation with said core acquisition means to obtain a core sample from said formation;

reducing the pressure in the wellbore in the vicinity of the point of entry of said core acquisition means into said formation by injecting gas into said well and said tubing string to lift wellbore fluids through said tubing string to minimize the invasion of fluids into said core sample during the acquisition thereof; and withdrawing said core acquisition mean and said core sample from said well.

* * * * *